United States Patent [19]

Hayduchok

[11] 3,996,720

[45] Dec. 14, 1976

[54] YARN CUTTING AND PACKAGING MACHINE

[76] Inventor: Leon Hayduchok, 15 Sandy Lane, Trenton, N.J. 08610

[22] Filed: Jan. 12, 1976

[21] Appl. No.: 648,583

[52] U.S. Cl. ..... 53/23; 53/123

[51] Int. Cl.[2] ..... B65B 19/34; B65B 63/02; B65B 63/00

[58] Field of Search ..... 53/23, 123

[56] References Cited

UNITED STATES PATENTS

| | | | |
|---|---|---|---|
| 2,008,473 | 7/1935 | Shephard | 53/123 |
| 3,576,704 | 4/1971 | Groce et al. | 53/123 X |

*Primary Examiner*—Travis S. McGehee
*Attorney, Agent, or Firm*—Martha G. Pugh

[57] ABSTRACT

Yarn strands derived from a creel are compressed together in parallel orientation and moved forward by reciprocating clamping means. A knife periodically severs a bundle comprising preselected short yarn lengths, which is compressed together and dropped into a chute. An impeller pushes each bundle through the wedge-shaped lower end of the reciprocating chute which extends in turn into each of a series of plastic bags being furnished from a roll or by an associated machine. The filled bag is sealed, cut loose and tossed into a bin.

12 Claims, 18 Drawing Figures

YARN CUTTING AND PACKAGING MACHINE

BACKGROUND OF THE INVENTION

This relates in general to cutting and packaging machinery and, more particularly, to machinery for cutting and packaging bundles of yarn.

In accordance with prior art practice, short lengths of yarn for various types of handicraft operations, such as hooking rugs, have been conventionally wrapped for display or sale purposes in skeins or bundles held together by a paper or plastic band. The disadvantage of such a wrapping is that the free ends of the bundles or skeins may become soiled when handled by browsing customers, and the wrapping band may be readily broken, or one or more of the strands may be pulled loose from the bundle. In order to prevent this, it is desirable to completely enclose each of the bundles or skeins in a separate bag.

SUMMARY OF THE INVENTION

Accordingly, the principal object of the present invention is to provide an economical automated method and apparatus for cutting and stuffing yarn skeins into each of a series of prefabricated bags without the intervention of an operator.

Another object of the invention is to maintain the orientation of a bundle of cut strands of preselected lengths without the necessity for a preliminary wrapping or tying step.

These and other objects are attained by the method and apparatus of the present invention which involves the steps of taking a plurality of continuous strands of thread or yarn from a number of spools, which are mounted on a creel, and passing these strands through multiple holes in a screen-type board which maintains the strands in parallel orientation. The strands are forced together through a restricted opening to form a composite bundle which is clamped by means of a mechanical clamp (yarn advance clamp) against a reciprocating slide (yarn advance platform). The yarn bundle is then advanced a predetermined length beyond a stationary mechanical clamp (knife clamp) adjacent a cutting knife, which is mechanically actuated to cut off a selected length of the bundle comprising a plurality of short strands. The cut bundle is then deposited on a reciprocating platform. As the platform retracts, the cut bundle of yarn is conformed and then deposited into the open rear section of an elongated rectangular product chute. During passage of the yarn bundle down the chute, a cover plate (cut yarn clamp) is brought down to cover the top side of the chute, thereby forming a total enclosure for the yarn bundle passing the length of the chute. The forward end of the chute terminates in a wedge-shaped scoop which moves along the inside edge of a continuous double plastic selvage strip which connects with the open edges of a series of plastic bags being conveyed forward from a roll or an associated bag making machine. A mechanically operated plunger periodically moves forward from the rear end of the chute to push the yarn bundle down through the wedge-shaped end and, in turn, into each of a series of advancing plastic bags which are periodically moved over the wedge section of the chute. Clamps advance the yarn filled bag to cutting and sealing means; and an arm removes the filled, sealed bag to a collection bin.

The system is controlled by a series of synchronously driven cams which operate microswitches to control pneumatic means for operating the clamps, knife, reciprocating platform, plunger and product chute.

A particular advantage of the system of the present invention is that it can be operated to perform its yarn cutting and bag filling functions substantially without the aid of human hands. Other objects, features and advantages will be apparent from a study of the detailed specification hereinafter with reference to the attached drawings.

DETAILED DESCRIPTION

Figure 1:
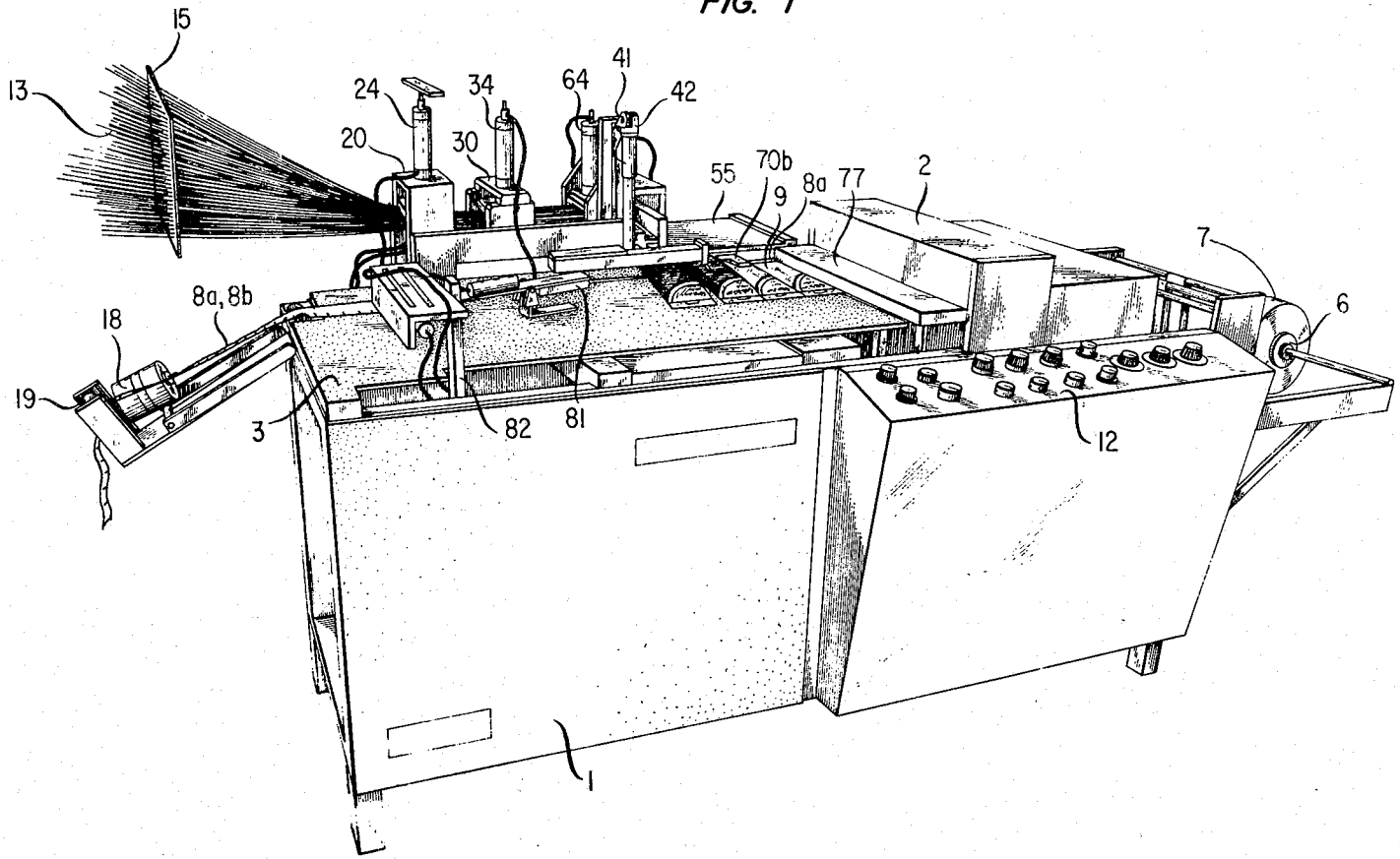
FIG. 1 is an overall showing of the yarn cutting and packaging mechanism of the present invention in collaboration with a machine for forming and supplying plastic bags thereto.

Referring now to FIG. 1 of the drawings, there is shown in perspective an overall view of the yarn cutting and packaging machine 1 of the present invention in combination with a machine 2 for making bags.

The combination includes a flat work surface 3 which, for convenience, is disposed about 2½ feet above the surface of the floor. The work surface 3 preferably comprises a material, such as tetrafluoroethylene, known by the trademark "TEFLON," or any other material characterized by a similar low coefficient of friction.

Figure 8:
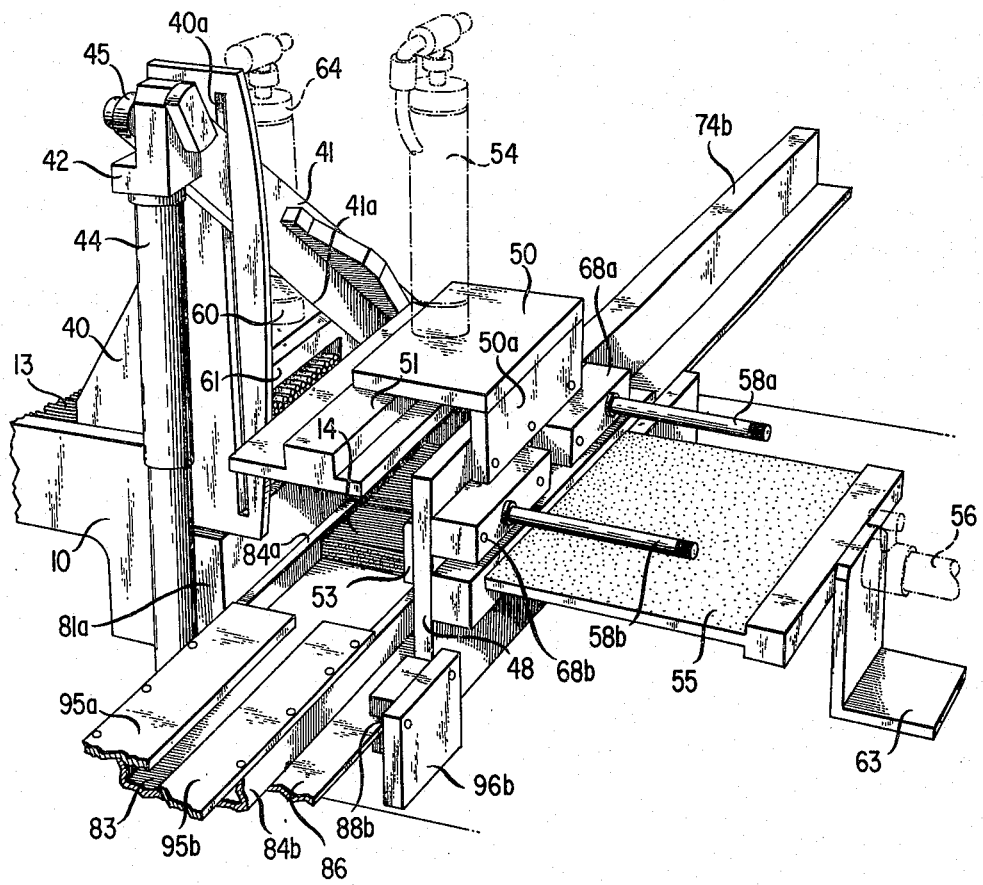
FIG. 8 is a showing of the right-hand rear section of the machine, including the cutting mechanism of FIGS. 2–7, after the cut yarn platform has been withdrawn, dropping the yarn bundle into the product chute.

The bag making machinery 2 may, for example, be of the general form shown and described in U.S. Pat. No. 3,599,388 issued to Norman Feingold, Aug. 17, 1971 (made a part hereof by reference), with the following modifications. In the bag making machine used by applicant, the bag making supply web 7 comprises, for example, low density polyethylene or other suitably flexible material of plastic or the like which has been doubled longitudinally, in the manner indicated in FIG. 8 of U.S. Pat. No. 3,599,388 supra. The plastic supply reel 6 has its axis parallel to the work surface 3 so that as the web 7 is positioned to be worked on, it is also maintained substantially parallel to work surface 3. The product bags 9, closed on the bottom ends after having been sealed along the sides and cut back to the double selvage 8*a*, 8*b* (not shown), are paid out onto the horizontal plane of the work surface 3. The bags are moved forward by the selvage connection at their open ends and are slidably propelled along work surface 3 by clamping bar 77 and clamping means 70*a*, 70*b* (not shown) gripping the double selvage strip 8*a*, 8*b*. After individual bags have been filled in succession with bundles of cut yarn product, in the manner described hereinafter, the filled bags are cut from selvage 8*a*, 8*b* and sealed by sealing means and removed by clamping means 81 to a collection bin. The selvage 8*a*, 8*b* is driven by motor 18 and rolled up on pinch rollers 19.

It will be understood that many different machines of types well-known in the art can be employed for making the bags or containers used in the packaging process set forth in the present invention. For example, it will be understood that the process of the present invention can be practiced using preformed bags connected together at their open ends, in which case the preformed bags would be paid out in flat relation to the work surface 3 from dispensing means mounted adjacent thereto, in lieu of the bag forming and supplying means 2. In such case, the spool spins freely, the bags 9 attached thereto being pulled along at a rate determined by operation of clamping means 70*a*, 70*b* on selvage 8*a*, 8*b*, as will be explained hereinafter. It will be understood that all of these operations are controlled by a pneumatic control system which will be described hereinafter with reference to FIG. 12.

Figure 2:
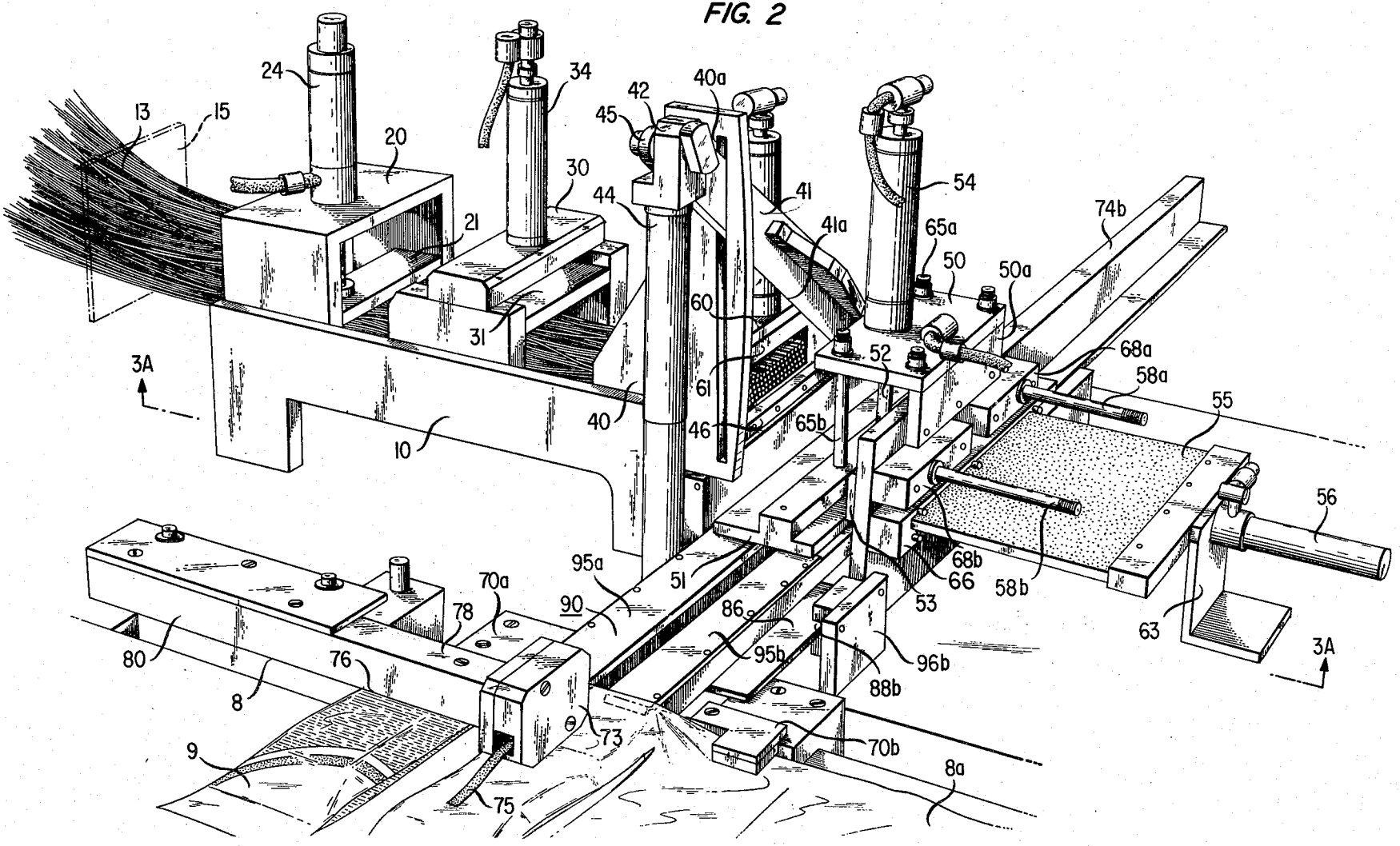
FIG. 2 is an enlarged showing, in perspective, of the yarn cutting and packaging machine of FIG. 1, in completely retracted position, at the beginning of a stroke for packaging a yarn bundle.
Figure 3B:
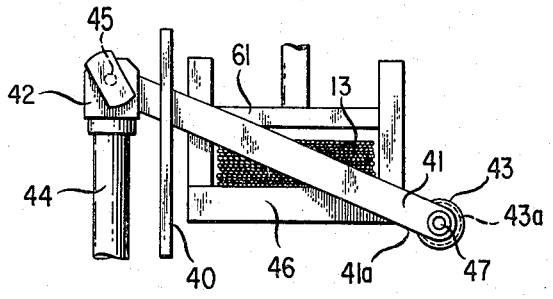
FIG. 3B is a cross-sectional view through the plane indicated by the arrows 3B—3B of FIG. 3A.
Figure 3A:
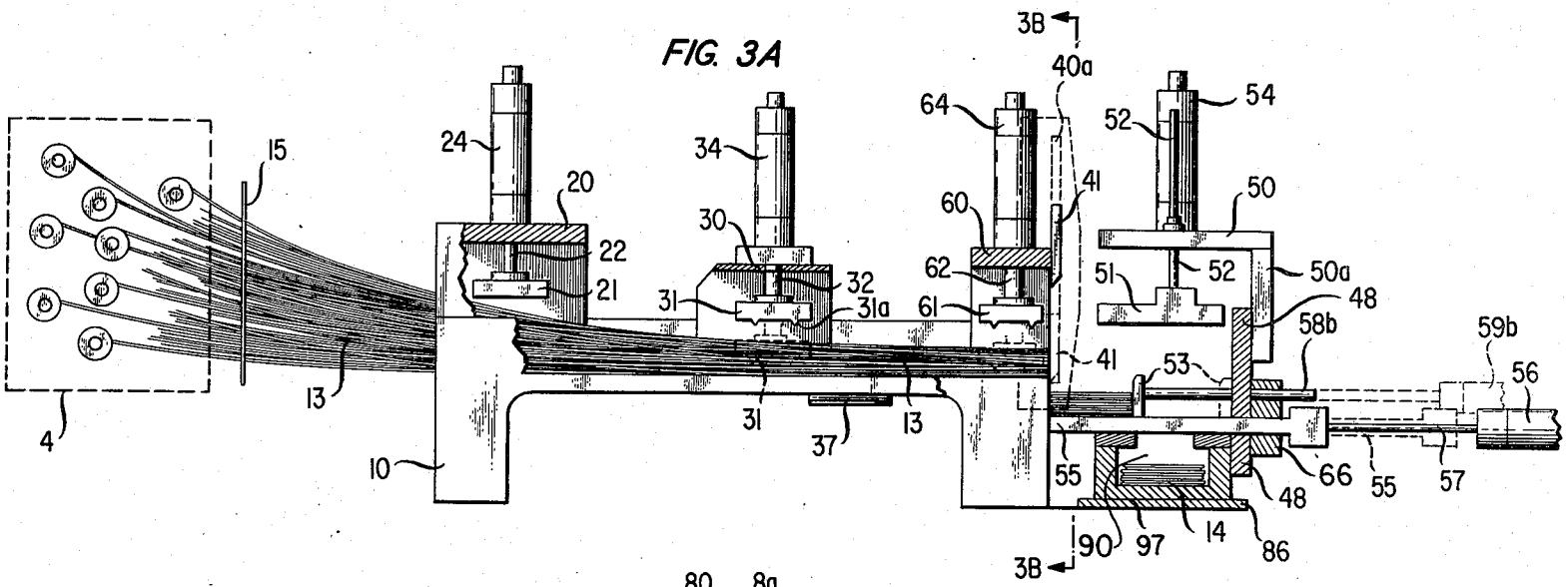
FIG. 3A is a longitudinal sectional view of the system of FIG. 2, along the plane indicated by the arrows 3A—3A, including the yarn supplying creels.

Referring in detail to FIGS. 2, 3A and 3B, the system of the present invention comprises a large number of spindles, say 300, mounted on a creel 4 (see FIG. 3A). The strands of yarn are passed through a board 15 which has holes arranged in rows and columns to accommodate each of the strands, imposing on the bundle a rectangular orientation. The yarn bundle 13 is passed into a trough 10 comprising a rectangular bed, 7 inches wide, 1 inch high and extending approximately 4 feet in a horizontal plane.

The yarn bundle 13 is first passed through the housing 20 of the emergency material hold clamp 21. Housing 20, preferably of stainless steel or other rigid metal, comprises the top and two sides of a box-like enclosure, the outer walls just fitting into the inner walls of the trough 10. This provides a rectangular opening 7 inches wide and 4 inches high, above the upper surface of the trough 10. Centered in the top of the housing 20 is an air cylinder 24. The clamp 21, which is preferably stainless steel, 7 inches wide, 3 inches long and ½ inch thick, is mounted to move slidably against the inner walls of the housing 20, propelled by a central supporting shaft 22, which is connected to a piston (not shown) which reciprocates in the cylinder 24. Clamp 21 is normally biased in open position against the tension of a pair of springs (not shown). It is designed to close with a force of 40 pounds. When power to the system is turned off, cylinder 24 pneumatically actuates clamp 21, causing it to drop down and clamp the yarn bundle 13 in place.

Figure 4:
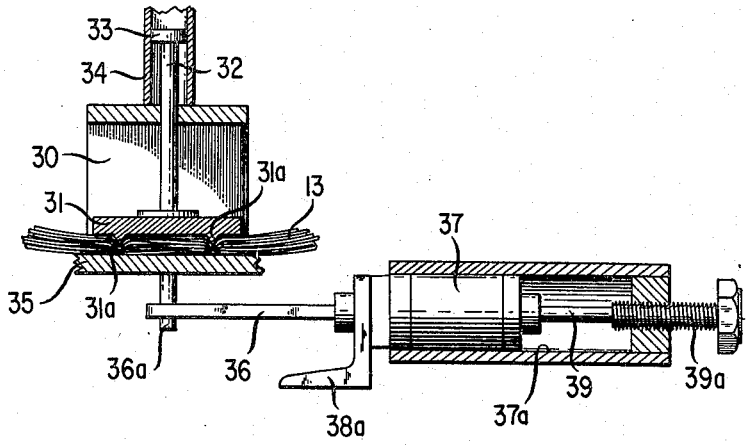
FIG. 4 is an enlarged sectional view of the yarn advance mechanism of FIG. 3A.

A second clamp housing 30 is also mounted on trough 10, spaced apart about 2 inches to the right of the housing 20. This houses the yarn advance clamp 31. Housing 30, preferably of metal, say, stainless steel, comprises a pair of parallel sides 4 inches wide, 4 inches high and 1 inch thick, which are respectively fitted against the inside walls of trough 10. The side walls of housing 30 are held together by a top plate 2 inches wide, 7 inches across and 1 inch thick. In the center of the top plate is mounted a pneumatic air cylinder 34, similar to cylinder 24. A piston 33 (not shown), which is constructed to move down in response to air pressure in cylinder 34, propels an axial shaft 32 which terminates in the clamp 31. The latter is a stainless steel plate 6 inches long, 4 inches wide and ½ inch thick, on the bottom face of which are a pair of sharp ridges or striations 31*a*, transverse to the principal direction of the trough, which serve to engage and hold in place the yarn bundle 13 passing through housing 30 against yarn advance platform 35 with a force of 120 pounds (see FIG. 4). Yarn advance platform 35, which is a steel plate 4 inches wide, 7 inches long and 1 inch thick, is located in slidable relation to the inside floor of the trough 10 and is disposed to move with reciprocating motion, adjustable to between 2 and 4 inches along the inside floor of trough 10 from an initial position, at which its left-hand end coincides with the left-hand end of housing 30, to an extended position at which its right-hand end is at a position just to the left of knife housing 60. The yarn advance platform 35 is propelled back and forth by arm 36*a* connected to an axle 36 which passes through an opening in bracket 38*a* which supports cylinder sleeve 37*a*. Piston 38 (not shown) moves in response to pneumatic pressure in cylinder 37, which is attached below trough 10. The length of the excursions of yarn advance platform 35 and, hence, the length of the cut yarn can be controlled by adjusting the screw mechanism 39*a* which changes the initial location of piston 38 in sleeve 37*a*.

Four inches along the trough 10 from the right-hand end of housing 30 is the left-hand end of knife clamp housing 60, which is similar in form and material to housings 20 and 30. The top is 2 inches wide, 7 inches long and ½ inch thick; and the rectangular sides are 4 inches wide, 4 inches high and ½ inch thick and just fit flush inside the walls of the trough 10. Knife clamp 61, disposed to ride up and down in housing 60, is 6 inches long, 2 inches wide and ½ inch thick and is formed of stainless steel or the like. In a manner similar to clamps 21 and 31, knife clamp 61 is operated in response to air pressure in the air cylinder 64, which is centered on the top of housing 60. After the yarn advance clamp 31 has moved the bundle of yarn 13 into position about two inches (or other cut yarn length) beyond cutting blade 41, a piston 63 (not shown) is forced downward in the sleeve 64, causing the central shaft 62 to move knife clamp 61 to secure the bundle of yarn 13 in position.

As shown in FIG. 3B, the movable cutting knife 41 comprises a piece of stainless steel or the like, 14 inches long, 2 inches wide and ¼ inch thick. It is pivotted at its right-hand end by means of a steel pin 47 mounted in bearing 43, and is maintained at about 50 pounds bias by spring 43*a*, so that it rotates counterclockwise against the bias of the spring in a plane normal to the direction of travel of the yarn in trough 10. Vertical slot 40, to the left of knife 41, acts as a guide for knife 41. The left-hand end of movable knife 41 is rotatably pivotted so that a pin 45 is mounted in pivot block 42. The latter is supported on top of an extendable sleeve 44 of an air cylinder.

The cutting edge 41*a* of movable knife 41, which may, for example, be of tool steel, honed to a sharp edge, is disposed to engage fixed blade 46 in cutting relation. Fixed blade 46 extends six inches across the bottom open edge of trough 10, just behind the plane of knife 41.

Immediately adjacent the cutting plane of knife 41 and disposed at right angles to the principal direction of trough 10 is the product chute 90.

FIGS. 5, 6, 7 and 8 show, in succession, steps performed by the machine: (1) cut yarn platform 55 moves into place; (2) yarn bundle 13 is extended over cut yarn platform 55; (3) cut yarn bundle 14 falls to platform 55 immediately after cutting; and (4) cut yarn bundle 14 is stripped from platform 55 by yarn stripper plate 53 and falls into product chute 90.

Figure 5:
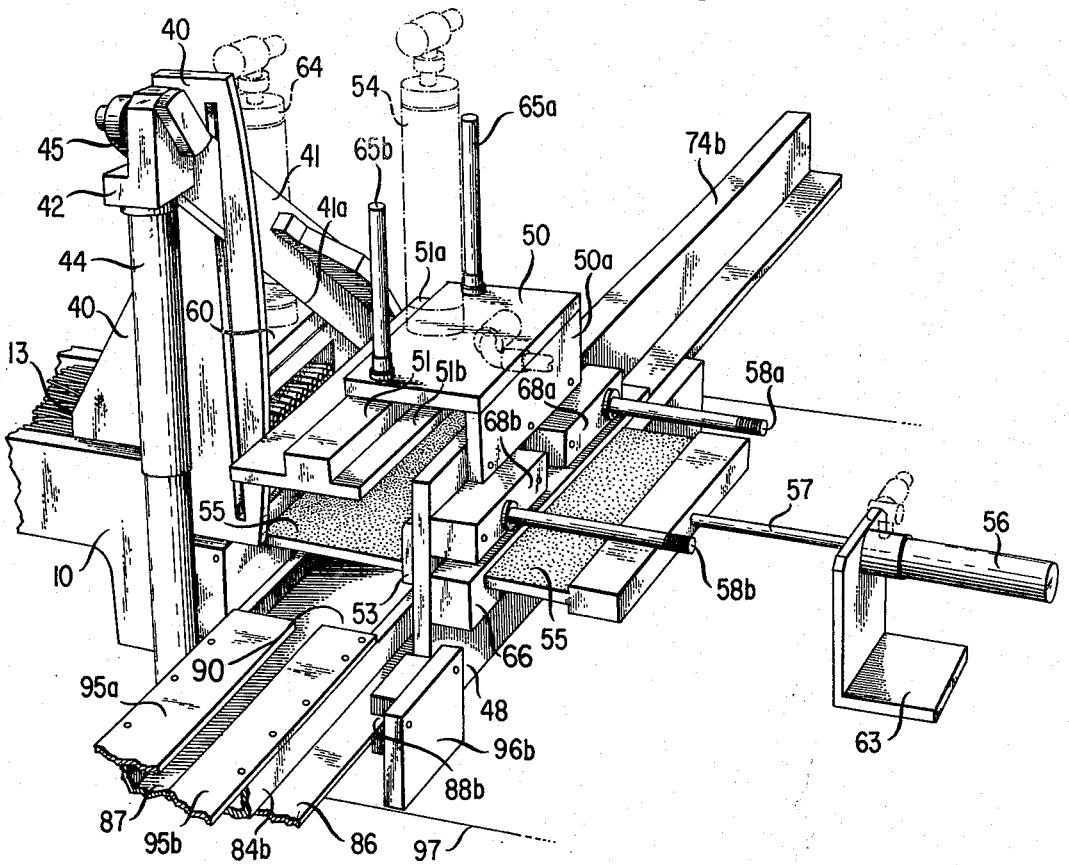
FIG. 5 is an enlarged showing of the rear, right-hand section of the machine of FIGS. 1 and 2 with the yarn cutter platform advanced and the cut yarn clamp raised, prior to the cutting operation.
Figure 7:
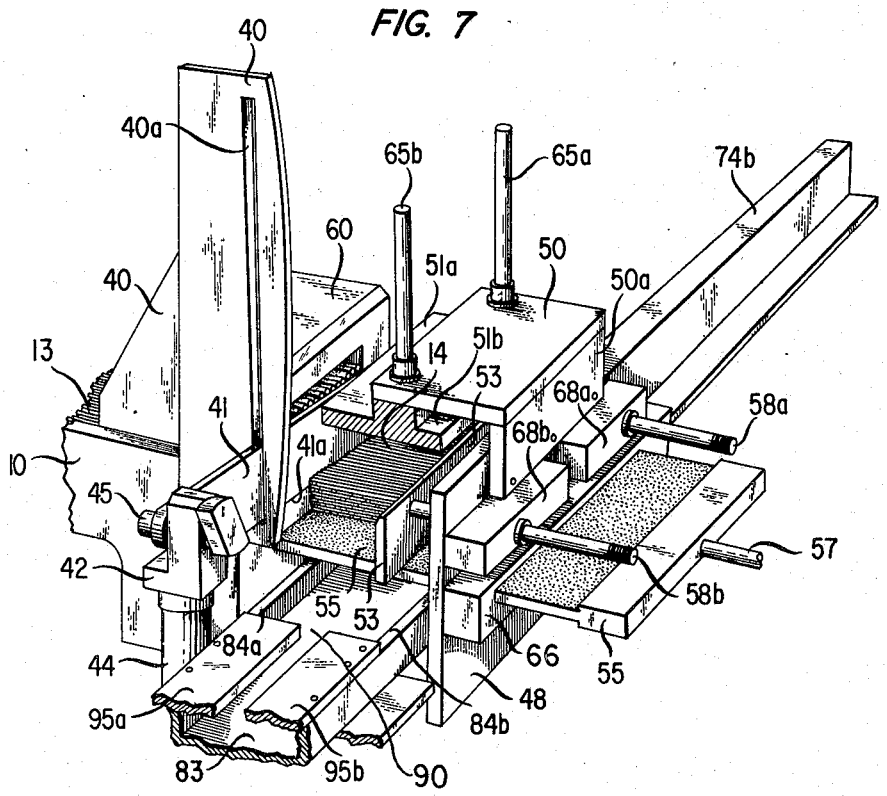
FIG. 7 is a showing of the cutting mechanism of FIG. 6 with the yarn bundle falling onto the yarn cutter platform.
Figure 6:
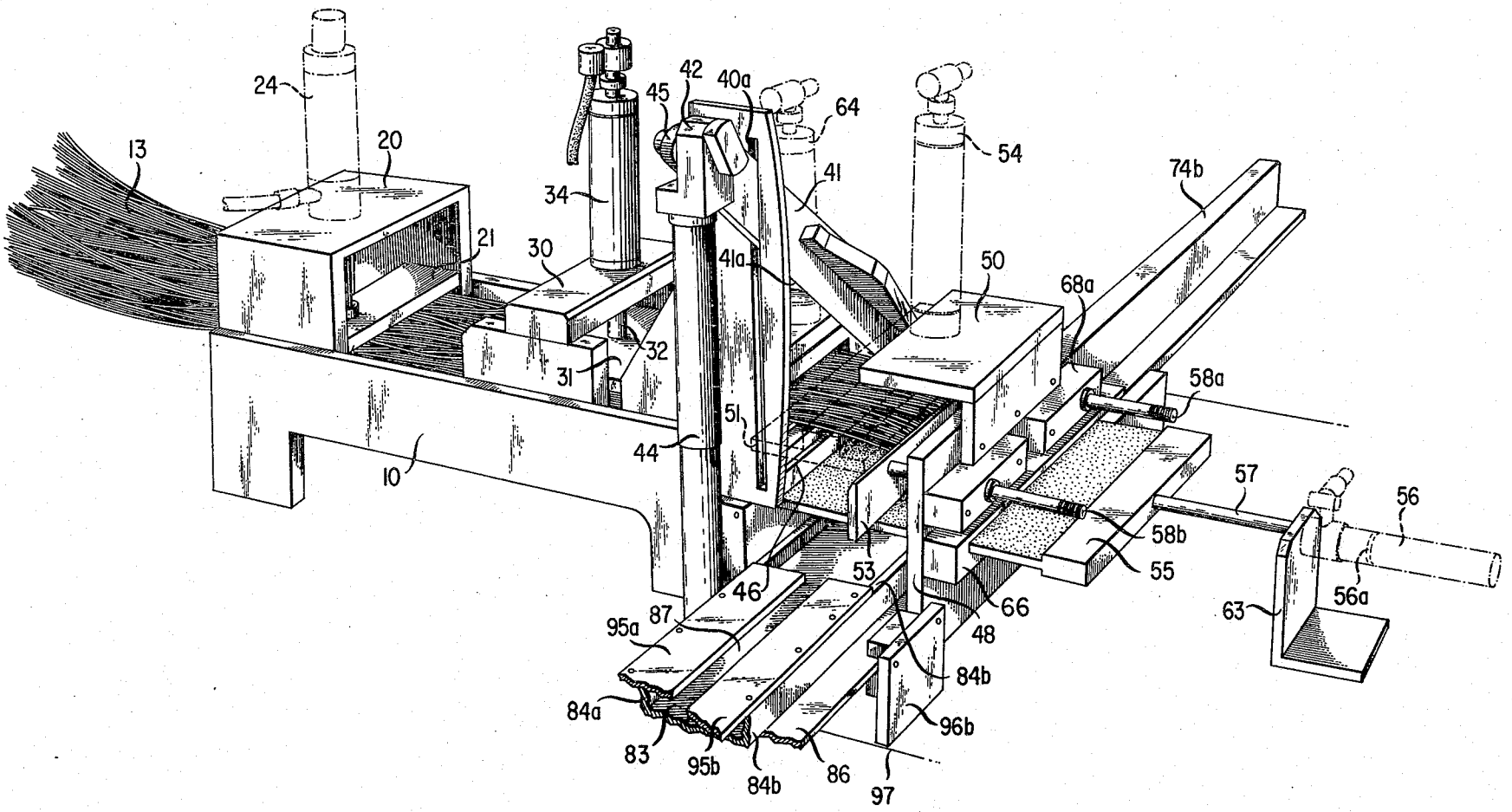
FIG. 6 is an enlarged showing of the cutting mechanism of the machine of FIGS. 2 and 3A with the yarn clamp raised and the yarn bundle advanced just prior to the cutting operation.

Referring to FIG. 5, 6 and 7, to maintain the strands of the cut yarn bundle 14 in conformed relation immediately after they are severed by the knife 41, and before the bundle falls into the product chute 90, bundle 14 is first intercepted by the cut yarn platform 55, fully extended. Platform 55 comprises a rectangular metal plate 10 inches long, 8 inches wide and ⅛ inch thick, which is slidably mounted in a supporting block 66. The latter is held in position by a vertical bracket 48 which is fastened to the base plate 97 near the terminal end of trough 10 opposite the cutting plane of knife 41. Cut yarn platform 55 is connected at its left-hand end to shaft 57 which terminates in piston 56*a* (not shown) of the air cylinder 56 so that it moves in a lateral direction in response to air pressure in cylinder 56. When cut yarn platform 55 is in fully extended position, prior to the time at which blade 41 severs the yarn bundle 14, it completely covers the open rear end of product chute 90 and is disposed immediately below fixed blade 46 and flush with the right-hand end of trough 10, so as to catch bundle 14.

Constructed to move cooperatively with cut yarn platform 55 is the yarn stripper plate 53, comprising a metal bar 10 inches long, 2 inches wide and ¼ inch thick, which is disposed in vertical relation to platform 55 to move with its lower edge sliding along the face of the latter. Yarn stripper plate 53 is connected to the ends of shafts 58*a* and 58*b*, which are mounted to move slidably in bearing blocks 68*a*, 68*b*, which are held in place against bracket 48. Shafts 58*a* and 58*b* are respectively connected to pistons 59*a* (not shown) and 59*b* in air cylinder 59 (see FIG. 3A). When cut yarn platform 55 moves to extended position, yarn stripper plate 53 is also moved laterally in response to air pressure in cylinder 59, so that the yarn bundle is conformed between the knife 41 and stripper plate 53. The latter moves back to a position at which it is aligned with the inside edge of chute wall 84*b*. When cut yarn platform 55 retracts to its initial or rest position, yarn stripper plate 53 remains in a substantially fixed position, thereby stripping the cut yarn bundle from the receding platform 55, whereby it drops into product chute 90.

During the period in which the cut yarn platform 55 is in extended position, cut yarn clamp 51 is in a fully raised position above the cut yarn bundle 14, where it remains until the cut yarn platform 55 is retracted and the cut yarn bundle falls into chute 90. At that time, cut yarn clamp 51 is lowered vertically to engage and cover the open portion of the chute, enclosing it completely after cut yarn bundle 14 drops into the chute.

Cut yarn clamp 51 is metal, 10 inches long and 4 inches wide. The edge portions 51*a* and 51*b* are 2 inches wide and ¼ inch thick and are designed to move in a vertical plane, engaging the rear edges of top plates 95*a* and 95*b*. Cut yarn clamp 51 is supported to move slidably on a pair of guide posts 65*a* and 65*b* which are respectively mounted in the left-hand corners of the rectangular support platform 50, the other two corners of which are supported by bracket 50*a* which is rivetted or otherwise secured to the vertically extended bracket 48. Centered near the left-hand end of support platform 50 is an air cylinder 54 (shown in phantom in FIG. 5), the piston of which (not shown) is connected to shaft 52 (FIG. 3A), which drives cut yarn clamp 51 into place on chute 90 in response to air pressure in cylinder 54.

Figure 9:
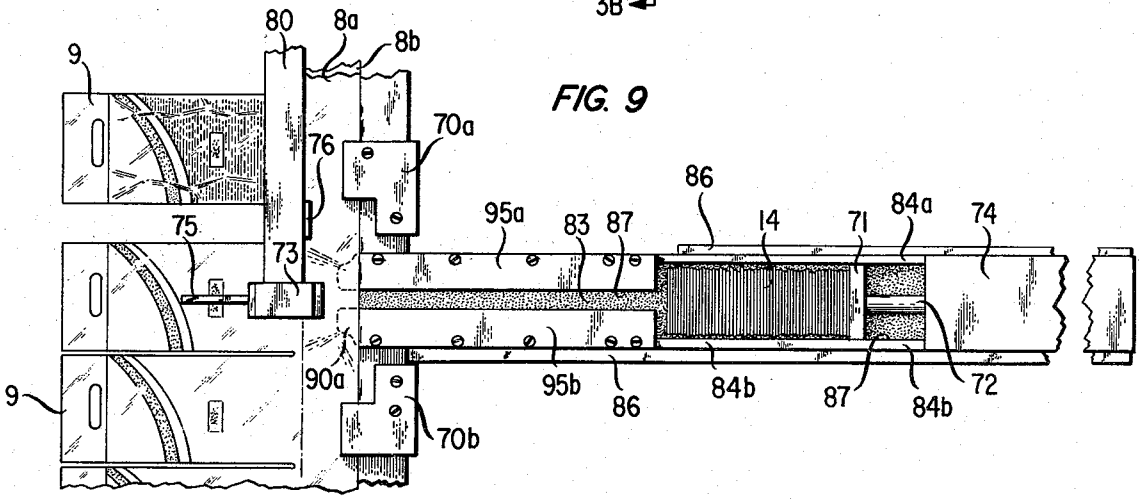
FIG. 9 is a top view of the product chute and product checking means of the yarn cutting and packaging machine of FIG. 2, et seq.
Figure 11:
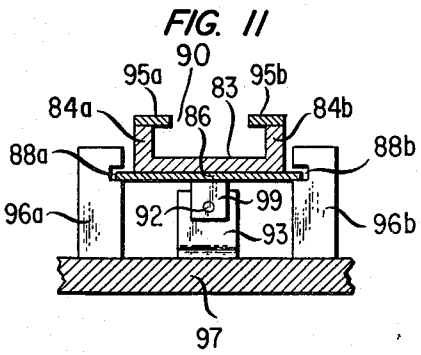
FIG. 11 is a cross-sectional view of the product chute assemblage through a plane indicated by the arrows 11—11 of FIG. 10.
Figure 10:
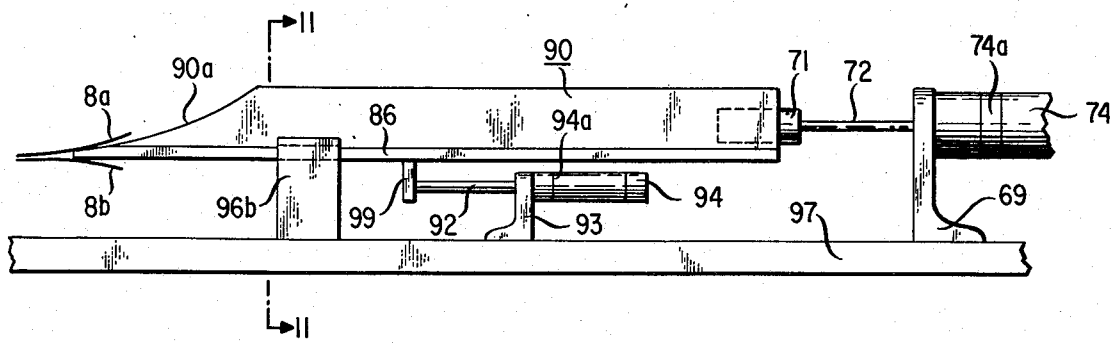
FIG. 10 is a longitudinal section of the product chute assemblage of FIG. 9.

Referring to FIG. 9, there is shown, in top view, details of product chute 90, shown in longitudinal section in FIG. 10 and in cross-section in FIG. 11.

Referring to FIG. 11, it is seen that chute 90 comprises an elongated rectangular channel 83 of stainless steel or the like, ⅛ inch thick. The inside width of channel 83 is 4 inches and the side walls are ¾ of an inch high. Respectively rivetted to the two top edges of channel 83 are a pair of longitudinal top plates 95*a*, 95*b*, each ⅛ inch thick, 1¾ inches wide and 10 inches long and spaced apart ½ inch to provide an opening 87. (FIG. 6.) The channel 83 is longitudinally disposed on slidable supporting plate 86, which is 5 inches wide and 14 inches long, so that the marginal edges of the latter each extend outward, slidably engaging the longitudinal slot 88*b* in lateral support 96*b*, slot 88*a* in lateral support 96*a*, and similar slots in a pair of similar supports to the rear, which are not fully shown. (See FIG. 11.) The left-hand forward end of supporting plate 86 has been indented to accommodate knife cylinder 44. Support 96*b* extends 2 inches high near the forward end of base plate 97, which runs the length of the product chute; and the other supporting means are of similar height.

Rigidly connected to and depending from slidable plate 86 is a block 99 which is the terminus of a shaft 92. As shown in FIG. 10, the latter is connected for reciprocating motion to a piston (not shown) of air cylinder 94, which is mounted in bracket 93, fixed to base plate 97 so that shaft 92 is constructed to move the slidable support plate 86 of the chute assemblage 90 a maximum distance of 2 inches forward, in response to air pressure in cylinder 94.

At the upper end of product chute 90, immediately adjacent the plane of knife 41 at the right-hand end of trough 10, plates 95*a* and 95*b* terminate. (See FIG. 6.)

Extending beyond are the top edges 84*a* and 84*b* of the side walls of channel 83 which define an enlarged opening to the product chute, being stepped back from a separation of ½ inch at opening 87 in the forward part of the chute, to an opening 4 inches wide, immediately adjacent the cutting area, for receiving cut yarn bundle 14.

Referring to FIG. 10, to the rear of the cutting area, another air cylinder 74 is supported in bracket 69, with its principal axis parallel to base plate 97. The shaft 72 is connected at one end to cylinder piston 74*a* and at the other end to plunger 71, which is constructed for reciprocating motion in product chute 90. In response to air pressure in the cylinder 74, plunger 71 approaches each cut bundle of yarn 14 from the rear as it falls into the product chute, and moves it a distance of about 22 inches along the length of the chute. The forward end of chute 90 terminates in a bevelled nose 90*a* (see FIG. 10). The bevelled surface forms an angle of about 30° with the bottom surface of chute 90.

During the continuous yarn cutting operation, as shown in FIG. 9, plastic container bags 9, which are closed on the bottom and two sides and are cut apart except for a double selvage 8*a*, 8*b* at one end, are moved forward along the work surface 3. The latter is preferably formed of a plastic material such as tetrafluoroethylene, known by the trademark TEFLON, to facilitate the sliding along of bags 9. The motion takes place in periodic discontinuous spurts under control of the transverse bar-shaped material clamp 77 (see FIG. 1). When the latter is operated, moving from a first position to a second position in a lateral direction along the work surface 3, clamps 70*a*, 70*b* on opposite sides of the chute 90 are relaxed to permit the double selvage 8*a*, 8*b* and connected bags to move forward. When bar clamp 77 releases, clamps 70*a* and 70*b* grip and hold firm selvage 8*a*, 8*b* on opposite sides of product chute 90. All of these elements are also responsive to operation by pneumatic cylinders, as set forth in FIG. 10. The bevelled nose 90*a* of product chute 90 is interposed between the travelling selvage layers 8*a*, 8*b*, about ½ inch deep during the interval between forward strokes of the product chute. When the latter moves forward it pushes the bevelled nose 90*a* about 2 inches deep, causing it to open up the particular bag in sequence to receive the cut yarn bundle 14.

Microswitch 73 is positioned with its tongue 75 on the top of the bag so that if no product is received into the bag, alarm means will be actuated, shutting off the machine. (See product check switch, FIG. 13.)

When the cut yarn bundle product 14 has been thrust into the bag 9, the full bag is displaced by an empty bag by operation of clamp 77, being held securely in place by clamps 70*a*, 70*b*. The filled bag is moved to the next succeeding position where it is contacted by a heat sealing and cutting, high resistance wire mechanism 76 on the underside of arm 80. Here, the filled bag is completely sealed and cut away from the selvage 8*a*, 8*b*. The filled bag 9 is then propelled into the clamping means 81 (see FIG. 1) which is driven to move rotatively about a pivot bar to discharge the filled bag into a receiving bin.

Figure 12:
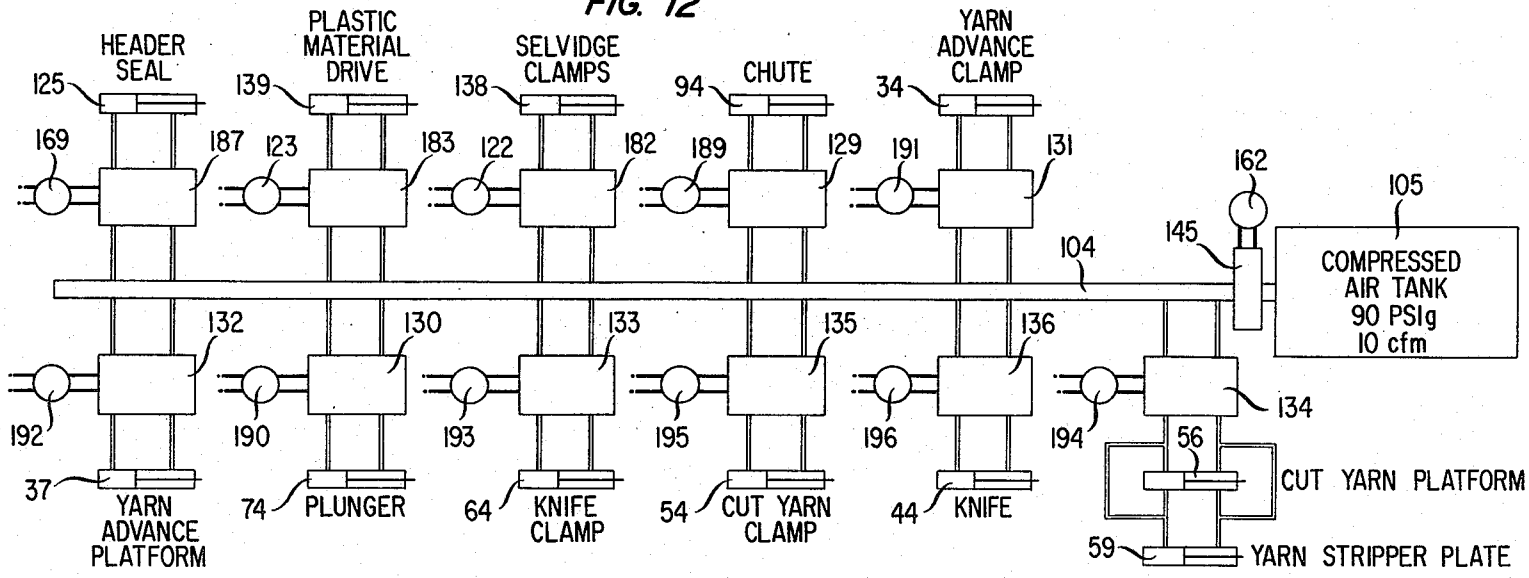
FIG. 12 is a schematic showing of the pneumatic control circuit of the system of FIGS. 2 et seq.
Figure 13:
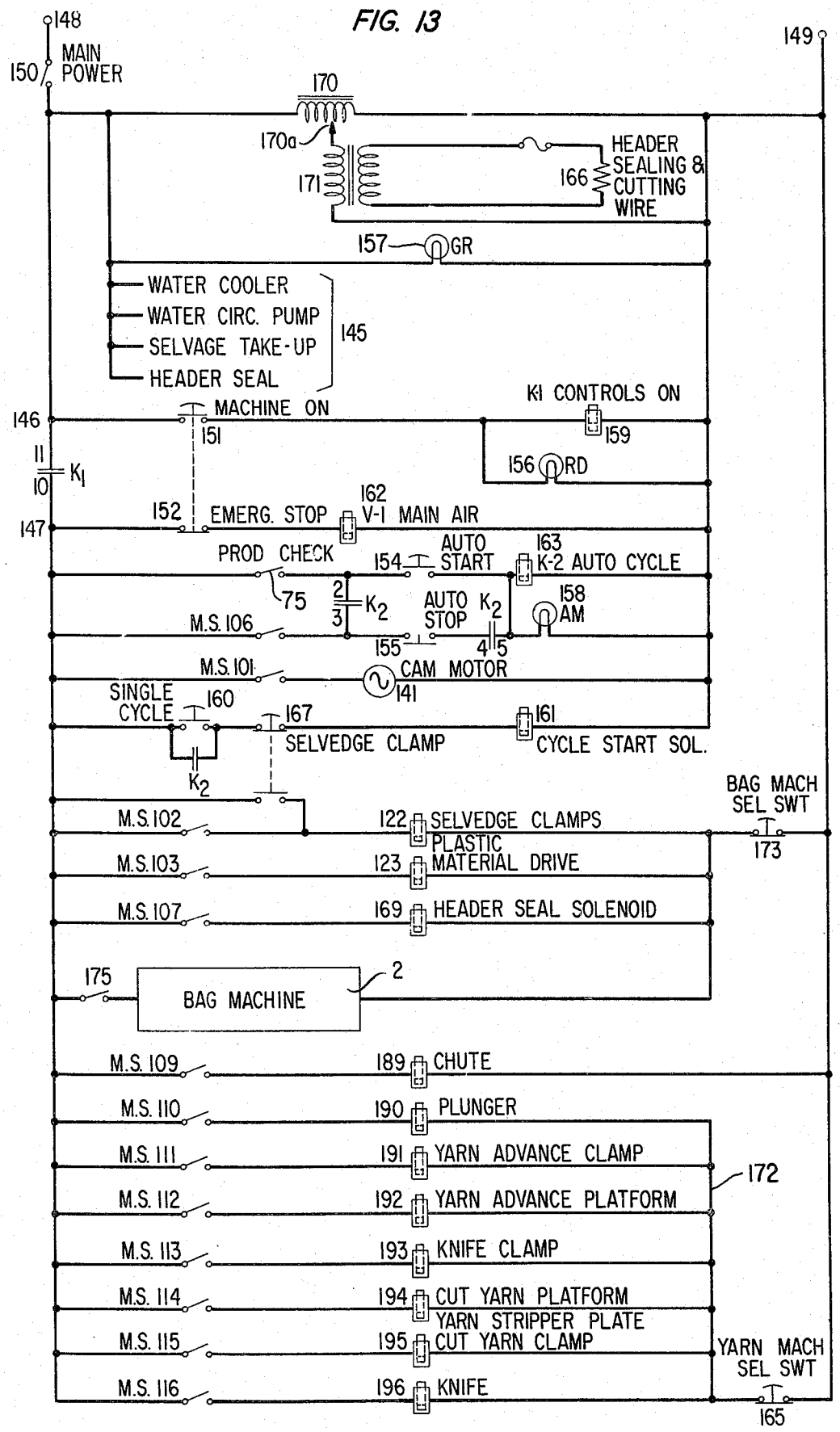
FIG. 13 is a schematic of the control circuit for the yarn cutting and packaging machine of FIGS. 2 et seq.

Referring now to FIGS. 12 and 13, there are shown the pneumatic and the electrical schematics for controlling the system disclosed in FIGS. 1 et seq.

Each of the operations heretofore described is controlled by the pressuring of an air cylinder through a solenoid-actuated valve under control of a cam-operated microswitch. The solenoid-operated valves hereinafter described may take any of the forms well-known in the art.

Compressed air for the system is furnished from tank 105, which supplies air under a pressure of 90 pounds per square inch (gravity), at 10 cubic feet per minute to the manifold 104, through master solenoid-operated valve 145. In the present example the manifold 104, which may comprise brass or copper tubing, has an inner diameter of ¾ of an inch. The feeder tubes and the auxiliary tubing of the pneumatic system preferably comprise conventional flexible plastic, such as polyethylene, polyvinylchloride or, alternatively, rubber or synthetic rubber or flexible metal hoses.

Figure 14:
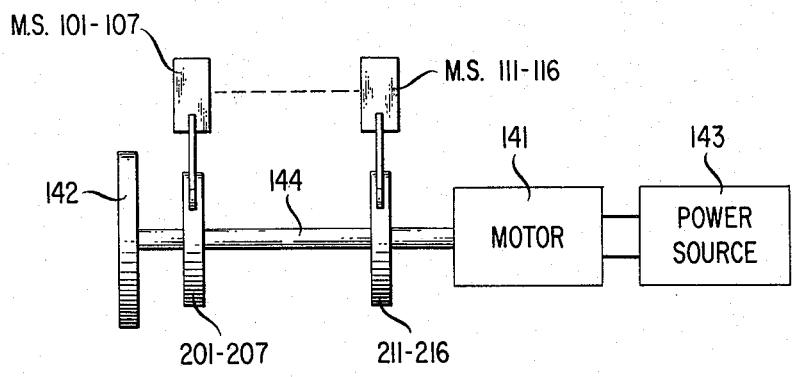
FIG. 14 shows the cam system and cam driving mechanism of the system of FIGS. 2 et seq.

The heart of the system is the cam shaft 140, shown in FIG. 14, supported in the bearing 142, which is driven to rotate at thirty revolutions per minute by the motor 141. The latter may be of any type well-known in the art constructed to generate up to 0.7 horsepower. Motor 141 is adapted to be connected to a conventional source of power 143. The functions of the system are controlled by 13 microswitches, numbered 101–107 and 111–116, each of which is constructed to be turned on and off by a corresponding one of the cams 201–207 and 211–216, typical ones of which are shown schematically shown in FIG. 14. Each of the individual cams takes substantially the form indicated in FIG. 15 for cam 201. The latter comprises a circular outer disk 201*b* having a perimeter on one half, with a larger radius, which is stepped back to a perimeter with a smaller radius on the other half. The initial position of the cam and, thus, the starting point at which microswitch 201 is actuated, is controlled by rotating disk 201*b* with reference to pointer 201*f* which is fixed relative to the rotation of shaft 144. A second, semicircular disk 201*c*, having a radius equal to the larger radius of disk 201*b*, is coaxially disposed with the latter so that the size of the cam opening 201*d* can be manipulated as desired by rotating disk 201*c* with reference to 201*b* and fixing set screw 201*e* to determine the point at which microswitch 101 is released.

The control circuit shown in FIG. 13 comprises power terminals 148 (positive) and 149 (negative) which are connected across a conventional 115 volt source of 60 cycle alternating current power. A conventional single throw toggle switch 150 connects to the main source of power.

Across the power terminals 148, 149 is disposed indicator light 157 in parallel with variable transformer 170. The slider 170*a* to the secondary of transformer 170 is connected across the primary of ten-to-one step-down transformer 171, which converts the power from 115 volts at 1 ampere to 11.5 volts at 10 amperes across the secondary, which is connected across a high resistance wire 166, about 6 inches long, which functions to simultaneously cut and provide a top seal for filled bags 9 when the same are moved to position 76 adjacent the clamp arm 80. (See FIG. 2.)

Also in parallel with the secondary of variable transformer 170 are a number of auxiliary circuits for a water cooling and circulating system, and for driving motor 18 for taking up selvage 8*a*, 8*b*, all of which are conventional and will not be described.

When power-on switch 150 is closed it connects the energizing circuit of K-1 relay 159 between positive terminal 146 and negative power terminal 149 through the spring loaded machine-on switch 151. Both of these switches are shown on the control panel of FIG. 16, as is indicator light 156 across K-1 relay 159. When K-1 relay 159 closes its contacts 10 and 11, this connects positive power junction 147 through the normally-closed spring loaded emergency stop switch 152, completing the circuit for the main air solenoid 162, which operates valve 145 to let air from compressed air tank 105 to flow into manifold 104 (see FIG. 12).

Also connected between the positive junction 147 and the negative terminal 149 are the following:

Energizing circuit is provided for the K-2 automatic cycle relay 163 in series with product check switch 75 and automatic-start switch 154. Indicator light 158 is in parallel with relay 163. Operation of K-2 relay coil closes its contacts 2 and 3 and 4 and 5.

1. This provides a circuit for lock-operating the automatic cycle K-2 relay 163 through the junction 147, operated microswitch 106 and normally-closed automatic-stop switch 155.

2. An operating circuit is provided through the operated microswitch 101 to initiate operation of cam motor 141 (see FIG. 14), which drives cam shaft 144 to rotate at thirty revolutions per minute, rotating each of cams 201–207 and 211–216.

3. A circuit is provided through the normally-open single cycle switch 160 (in parallel with contacts 10 and 11 of K-2 relay 163) and the selvage clamp switch 167 to energize the cycle-start solenoid 161.

The following additional circuits are provided (see FIG. 12):

4. Through cam-operated microswitch 102 to energize solenoid 122 to open valve 182 to air cylinder 138 for operating selvage clamps 70*a*, 70*b;*

5. Through cam-operated microswitch 103 for energizing solenoid 123 to open valve 183 to air cylinder 139 to initiate operation of plastic material drive clamp 77;

6. Through microswitch 107 to energize solenoid 169, opening valve 187 to air cylinder 125 to operate header seal 76;

7. Through cam-operated microswitch 109 to energize solenoid 189 to open air valve 129 to operate air cylinder 94 to move the product chute 90 forward;

8. Between positive terminal 147 and junction 172 to perform the following additional functions:

a. Through microswitch 110 to energize solenoid 190 to open air valve 130 to air cylinder 74 to operate the plunger of product chute 90;

b. Through microswitch 111 to energize solenoid 191 to open air valve 131 to air cylinder 34 to operate yarn advance clamp 31;

c. Through microswitch 112 to energize solenoid 192 to open air valve 132 to air cylinder 37 for operating yarn advance platform 35;

d. Through microswitch 113 to energize solenoid 193 to open air valve 133 to air cylinder 64 for operating knife clamp 61;

e. Through microswitch 114 to energize solenoid 194 to open air valve 134 to perform the dual functions of operating cylinder 56 for cut yarn platform 55, and cylinder 59 for yarn stripper plate 53;

f. Through microswitch 115 to energize solenoid 195 to open air valve 135 to air cylinder 54 for cut yarn clamp 51; and g. Through microswitch 116 to energize solenoid 196 to open air valve 136 to cylinder 44 to operate knife 41.

Figure 16:
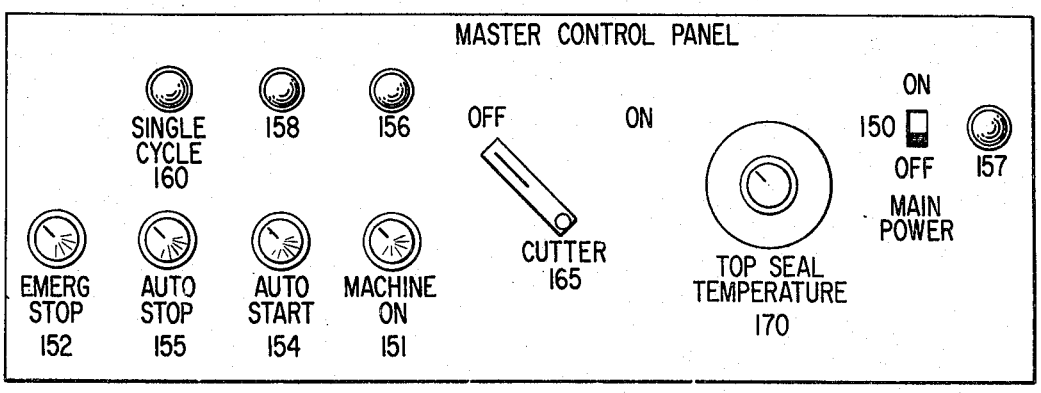
FIG. 16 shows the control panel for the yarn cutting and packaging system of FIGS. 2 et seq.

The junction 172 is connected to negative power terminal 149 through the closed yarn machine selector switch 165 which is on the control panel as shown in FIG. 16.

Figure 15:
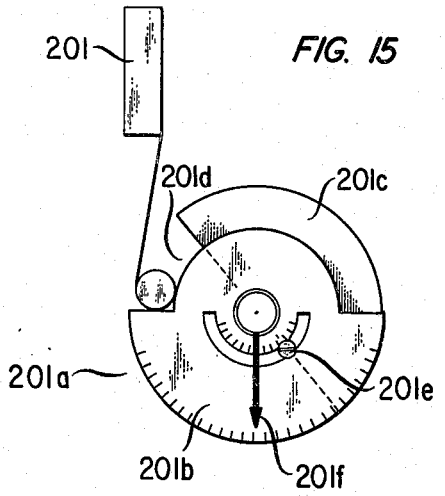
FIG. 15 is an enlarged showing of a typical cam and associated microswitch lever, corresponding to those shown in FIG. 14.

The sequence of events in the yarn cutting machine of the present invention is controlled by the settings on each of the motor driven cams on cam shaft 144, as shown in FIG. 15.

The settings for each of the cams controlling on and off times for the corresponding microswitches are indicated in Table I, below.

Also, connections to bag machine 2, relating to the formation of plastic bags 9, are initiated through the switch 175. The circuit of the bag making machine will not be described in this application, as it will be assumed, in general, to be similar to prior art bag making circuits, such as the bag making circuits described in detail in U.S. Pat. No. 3,599,388 supra.

TABLE I

CAM SETTINGS
(Readings are in percentages of cam cycle, clockwise)

| Cam No. | Description | Microswitch On | Microswitch Off |
|---|---|---|---|
| 201 | Cam Motor | 0 | 2½ |
| 202 | Selvage Clamps | 2½ | 17½ |
| 203 | Plastic Material Drive | 3½ | 15 |
| 207 | Top Seal | 40 | 10 |
| 209 | Chute | 20 | 70 |
| 210 | Plunger | 32½ | 60 |
| 211 | Yarn Advance Clamp | 10 | 80 |
| 212 | Yarn Advance Platform | 45 | 80 |
| 213 | Knife Clamp | 60 | 10 |
| 214 | Cut Yarn platform / Yarn Stripper Plate | 45 | 85 |
| 215 | Cut Yarn Clamp | 27½ | 40 |
| 216 | Knife | 60 | 85 |

Figure 17:
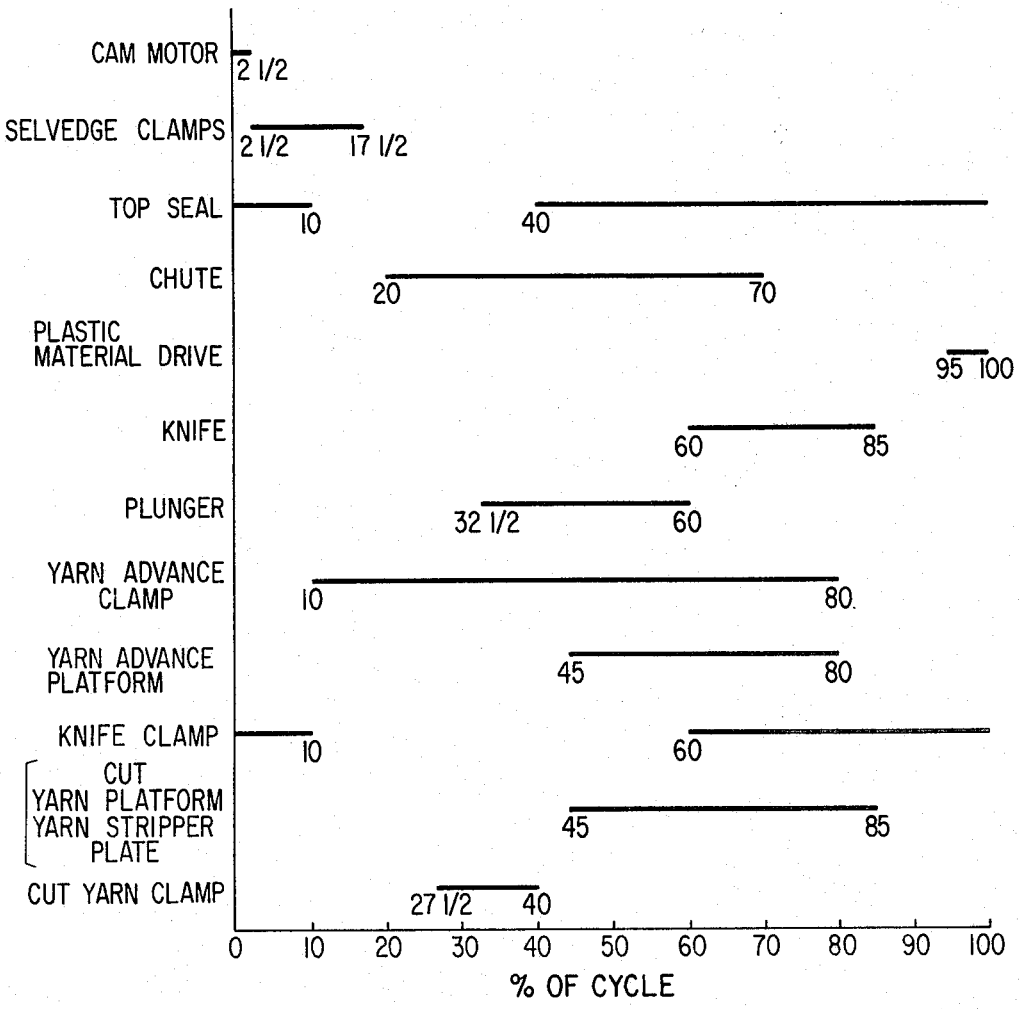
FIG. 17 is a flow chart showing the sequence of operations of the system indicated in FIGS. 2 et seq.

The sequence of operations is set forth in detail in the flow chart of FIG. 17, which shows the start and stop for each operation, in terms of the percentages of a single cycle.

To initiate operation of the machine of the present invention, power switch 150 is turned on, lighting indicator light 157. Subsequently, machine-on switch 151 is turned on, lighting indicator light 156 and energizing relay K-1 159. This causes the latter to close its contacts 10 and 11, closing the power circuit to the rest of the controls.

The operator manually depresses single cycle switch 160, energizing cycle-start solenoid 161. This starts one full cycle of the machine.

When the product is inserted into the bag 9, this closes the product-check microswitch 75, thereby allowing the operator to depress the automatic start button 154 to energize the K-2 relay 163, lighting indicator light 158. This causes the K-2 normally-open contacts 2-3, 4-5 and 10-11 to close, as follows:

a. Contacts 10-11 close circuit to the cycle-start solenoid 161, thereby initiating automatic operation of the machine.

b. K-2 contacts 2-3 and 4-5 latch the K-2 relay 163 closed.

Assuming switches 165 and 173 are closed, the operation of the machine then proceeds automatically, to perform the yarn advancing, cutting and bag-filling operations hereinbefore described.

At any time when a product is not inserted into a bag, product-check microswitch 75 will remain open during this checking period while the corresponding cam is open, thereby deenergizing the K-2 relay 163 so that its contacts 10-11 open, stopping further cycles of the machine.

It will be understood that although a specific example has been described as an illustration of the method and apparatus of the present invention, the invention is not limited to the specific form shown and described, but only by the scope of the appended claims.

What I claim is:

1. A system for cutting and packaging a bundle of yarn comprising in combination:

a creel comprising a plurality of spools, each wrapped with a separate continuous strand of yarn;

guide means comprising a conduit for conforming said strands in parallel orientation into a coherent bundle;

means for periodically clamping said bundle at a selected position along said conduit and moving said bundle forward a preselected distance to a second position in said conduit;

cutting means disposed beyond the second position of said conduit, having its operation synchronized with said clamping and forward moving means, and constructed and arranged to periodically cut a preselected length from said bundle extended beyond the plane of said cutting means;

means comprising a product chute adjacent said cutting means for periodically receiving and delivering the cut lengths of said yarn bundle;

said product chute comprising a reciprocating plunger constructed to move internally in said chute in synchronism with said clamping and cutting means for pushing said cut yarn bundle to the forward end of said chute;

means for moving a series of open containers to register with the end of said product chute in synchronism with said clamping and cutting means, and said reciprocating means;

said product chute being wedge-shaped and constructed on the forward motion of said reciprocating plunger to move forward into each of said containers and to deliver one of said cut yarn bundles to fill said container, and then to withdraw; and means synchronized with said clamping and cutting means, and said reciprocating means, for removing each of said filled containers to collecting means.

2. The combination in accordance with claim 1 comprising a pneumatic control system including separate pneumatic controls for actuating each of said yarn clamping, advancing and cutting means, and the reciprocation of said product chute and said product plunger; and a series of synchronized motor driven cams and associated relay means for actuating said separate pneumatic controls in a preselected sequence.

3. The combination in accordance with claim 1 wherein said series of containers comprises a series of plastic bags having their open ends interconnected by a continuous double selvage;

said wedge-shaped product chute constructed to rest with the small end of said wedge interposed between the leaves of said double selvage as said bags are moved laterally in periodic intermittent steps by clamping means contacting said selvage;

the wedge-shaped end of said product chute constructed and arranged to move forward to open each of said bags in turn to receive a cut yarn bundle pushed forward by said reciprocating plunger.

4. The system in accordance with claim 3 which includes a work surface having a coefficient of friction not exceeding about the coefficient of friction of tetrafluoroethylene;

said product chute being disposed for reciprocating motion on said work surface; and the said series of plastic bags being oriented in a horizontal plane to slide over said work surface to periodically register with said product chute.

5. The combination in accordance with claim 1 wherein said means comprising said product chute includes a cut yarn platform constructed and arranged to move with lateral reciprocating motion above the opening of said product chute to intercept each cut yarn bundle falling from said cutting means, and cut yarn stripping means having its principal plane substantially normal to said cut yarn platform and constructed to move synchronously, when said platform is extended, to clamp the edge of said falling yarn bundle, and to remain substantially stationary as said platform is retracted, stripping said bundle from said platform and into said product chute.

6. The system in accordance with claim 5 including a cut yarn clamp constructed to move with vertical reciprocating motion in synchronism with said cut yarn platform and said yarn stripping means to assume a raised position when said cut yarn platform is extended and to engage and cover said product chute when a cut yarn bundle is stripped off of said cut yarn platform into said product chute.

7. The system in accordance with claim 1 comprising normally open emergency clamping means actuated in response to power cut-off in said system to clamp said bundle of yarn in a stationary position in said conduit.

8. A method of cutting and packaging a bundle of yarn comprising the steps of:

guiding a plurality of continuous strands into a single coherent bundle of strands of substantially parallel orientation;

periodically clamping said yarn bundle at a selected position and advancing said bundle forward a preselected distance to a second position;

periodically advancing said bundle beyond said second position a preselected distance beyond the plane of cutting means and cutting a preselected length from said bundle;

periodically depositing each said cut yarn bundle in a product chute;

furnishing a series of containers to register with the forward end of said product chute in synchronism with the motion of said yarn clamping and yarn advancing means;

internally pushing each said cut yarn bundle to the forward end of a wedge-shaped product chute;

simultaneously moving the wedge-shaped forward end of said product chute into each said container in turn to fill said container with a yarn bundle; and sealing and removing said filled containers.

9. The method in accordance with claim 8 of pneumatically actuating each of said clamping, yarn advancing and cutting operations, and the reciprocating operations in and of said chute, by synchronously triggering said operations by cam-operation relay means.

10. The method in accordance with claim 8 in which a cut yarn platform is interposed with lateral reciprocating motion above the opening of said product chute to intercept the cut yarn bundle after each cutting operation; and each said cut yarn bundle is stripped from said cut yarn platform into said product chute as said cut yarn platform retracts.

11. The method in accordance with claim 10 which includes a step of moving a cut yarn clamp with vertical reciprocating motion to cover the yarn bundle in said product chute, which is carried out in synchronism with the motion of said cut yarn platform and the stripping of said yarn bundle into said product chute.

12. The method in accordance with claim 8 wherein the step of furnishing a series of containers comprises:

sliding in a horizontal plane adjacent the wedge-shaped forward end of said product chute a series of plastic bags having their open ends connected by a continuous double selvage, the small end of said wedge being interposed between the double leaves of said selvage as said bags are moved laterally to register in turn with said product chute, wherein the forward motion of the wedge-shaped end of said product chute opens each of said bags in turn to receive a cut yarn bundle.

* * * * *